US006241346B1

(12) United States Patent
Takahashi

(10) Patent No.: US 6,241,346 B1
(45) Date of Patent: Jun. 5, 2001

(54) INK JET RECORDING HEAD INCLUDING A CONNECTING MEMBER FOR CONTROLLING THE DISPLACEMENT OF PIEZOELECTRIC VIBRATORS

(75) Inventor: Tomoaki Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/027,672

(22) Filed: Feb. 23, 1998

(30) Foreign Application Priority Data

Feb. 21, 1997 (JP) ..... 9-054180

(51) Int. Cl.[7] ..... B41J 2/045
(52) U.S. Cl. ..... 347/70; 310/328; 347/94
(58) Field of Search ..... 347/68, 70, 71, 347/50, 94; 310/334, 328

(56) References Cited

U.S. PATENT DOCUMENTS 4,586,056 * 4/1986 Kamura et al. ..... 347/188 X
4,791,440 * 12/1988 Elridge et al. ..... 347/50 X

FOREIGN PATENT DOCUMENTS 0548984 6/1993 (EP) .
0550030 7/1993 (EP) .
0563603 10/1993 (EP) .
0573055 12/1993 (EP) .
64-90755 * 4/1989 (JP) ..... 347/68
6-122196 * 5/1994 (JP) ..... 347/71
9-239977 9/1997 (JP) ..... B41J/2/045

* cited by examiner

*Primary Examiner*—Benjamin R. Fuller
*Assistant Examiner*—C. Dickens
(74) *Attorney, Agent, or Firm*—Sughrue, Mion, Zinn, Macpeak & Seas, PLLC

(57) ABSTRACT

An ink jet recording head designed to prevent the displacement characteristic of a piezoelectric vibrator from being varied depending upon the number of simultaneously driven piezoelectric vibrators. The recording head includes a passage unit, a vibrator unit and a connecting member. The passage unit includes a nozzle plate having a nozzle aperture therein, a passage forming plate having a pressure generating chamber and a reservoir, and an elastic plate. The nozzle plate, the passage forming plate and the elastic plate are laminated together. The vibrator unit includes a fixing plate, and a plurality of piezoelectric vibrators fixed at one end portion thereof to the fixing plate at a predetermined pitch and contacting the elastic plate at another end portion thereof. The piezoelectric vibrators are actuated in a longitudinal vibration mode for emitting an ink droplet by deflecting the elastic plate to expand or contract the pressure generating chamber. The connecting member is elastically deformable and extends across the piezoelectric vibrators in a transverse direction and is secured thereto. Dummy piezoelectric vibrators are disposed at opposite ends of the array of piezoelectric vibrators and an end of the connecting member is fixed to the dummy vibrator.

17 Claims, 8 Drawing Sheets

INK JET RECORDING HEAD INCLUDING A CONNECTING MEMBER FOR CONTROLLING THE DISPLACEMENT OF PIEZOELECTRIC VIBRATORS

BACKGROUND OF THE INVENTION

1. Field of the Invention

The present invention relates to an ink jet recording head for recording images and characters on recording paper by emitting ink droplets from nozzle apertures by the expansion and contraction of piezoelectric vibrators operating in a longitudinal vibration mode.

2. Background

It is known to use a recording head having piezoelectric vibrators which operates in a longitudinal vibration mode and which can be driven at a high speed. Such a recording head includes a passage unit formed by laminating a nozzle plate having nozzle apertures, a passage forming plate having pressure generating chambers and reservoirs, and an elastic plate. The recording head is driven by a vibrator unit including piezoelectric vibrators which expands and contracts in its longitudinal direction with one end of the vibrator being fixed to a fixing base.

With such a vibrator unit, since the rigidity of the vibrator itself is high, the area of the contact surface with the pressure generating chamber can be reduced and the vibrator unit will still be suitable for a recording head designed for high density printing. However, when high density printing is desired, there are the following concerns: (1) the array pitch is extremely small; (2) the reaction force which operates on a fixing base is extremely large; (3) the amount of deflection of the fixing base is varied depending upon the number of simultaneously driven piezoelectric vibrators; and (4) the capacity of the emission of ink droplets depends upon the number of simultaneously driven piezoelectric vibrators.

To address these concerns, measures have been taken, such as providing a fixing base made of a very rigid material and a reinforcement member, such as metal, inserted between a frame for integrally fixing the passage unit and the vibrator unit. However, there is a problem associated with this solution in that the fixing base is too large and the assembly is complicated.

SUMMARY OF THE INVENTION

The present invention is made to solve such problems and the object is to provide an ink jet recording head in which the displacement characteristic of each piezoelectric vibrator can be equalized without increasing the overall size of the recording head. Further, the displacement characteristics are consistent independent of the number of piezoelectric vibrators that are driven.

To solve such problems, according to the present invention, the ink jet recording head includes: a passage unit including at least one nozzle aperture, a chamber associating with said nozzle aperture, and an elastic plate serving as a part of a wall of said chamber; and a plurality of piezoelectric vibrators fixed at one end portion thereof to said fixing plate at a predetermined pitch and contacting said elastic plate at another end portion thereof, said piezoelectric vibrators being actuated in a longitudinal vibration mode for emitting an ink droplet by deflecting said elastic plate to expand or contract said pressure generating chamber; and an elastically deformable connecting member extending across said piezoelectric vibrators in a transverse direction and secured thereto. The displacement of the piezoelectric vibrators is controlled by the connecting member. Accordingly, in case multiple piezoelectric vibrators are simultaneously displaced, the mutual displacement and the displacement speed are equalized by the connecting member and the variation of the displacement characteristic depending upon the number of driven piezoelectric vibrators is controlled.

Further, dummy piezoelectric vibrators are disposed at opposite sides of the array of piezoelectric vibrators and an end of said connecting member is fixed to said dummy vibrator. Finally, according to one embodiment, the connecting member includes an elastically deformable ribbon cable for supplying a driving signal to said piezoelectric vibrators.

DETAILED DESCRIPTION OF THE INVENTION

Embodiments which show the details of the present invention will be described below.

Figure 1:
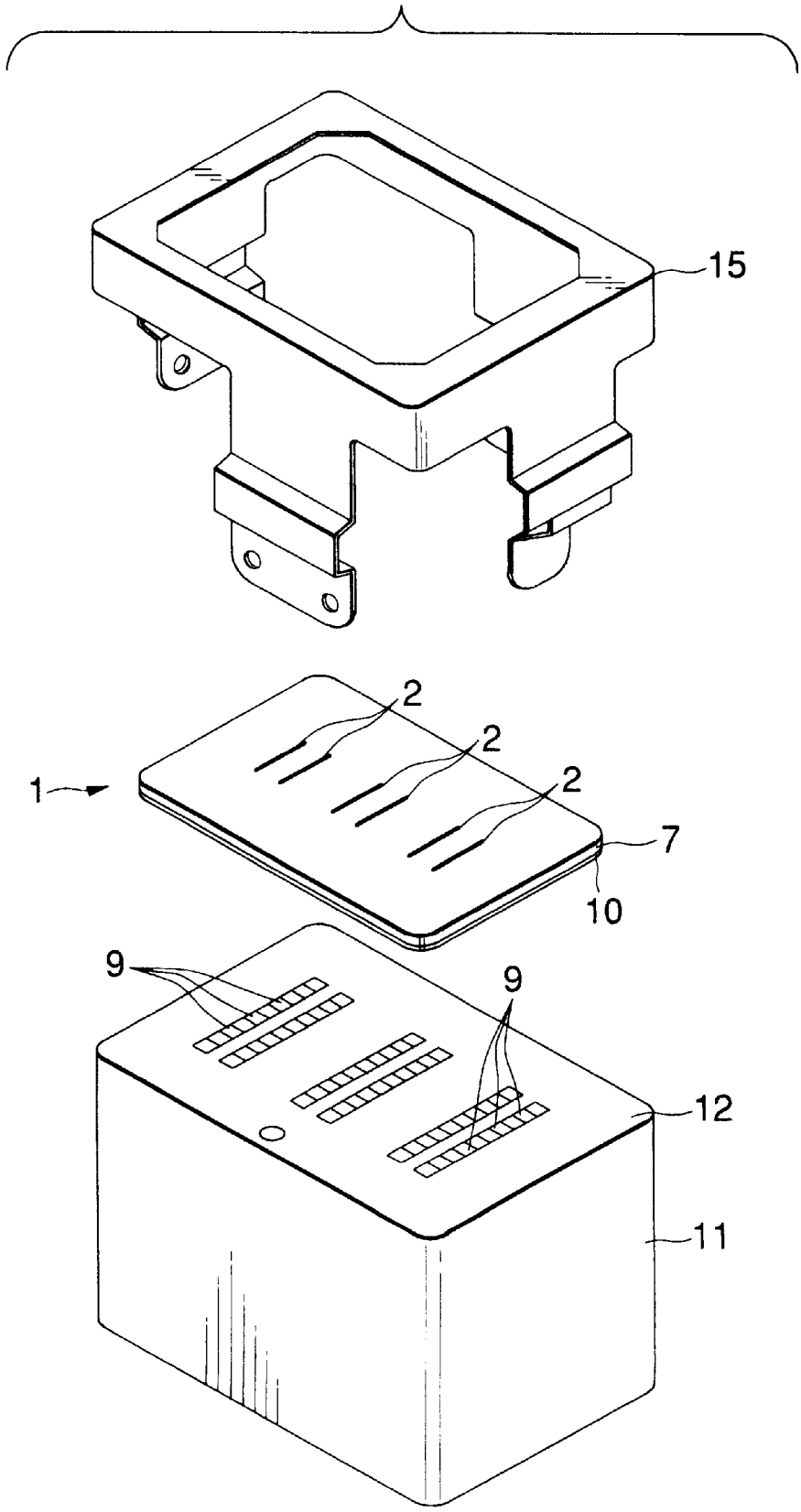
FIG. 1 is an assembly perspective drawing showing an embodiment of an ink jet recording head according to the present invention.
Figure 2:
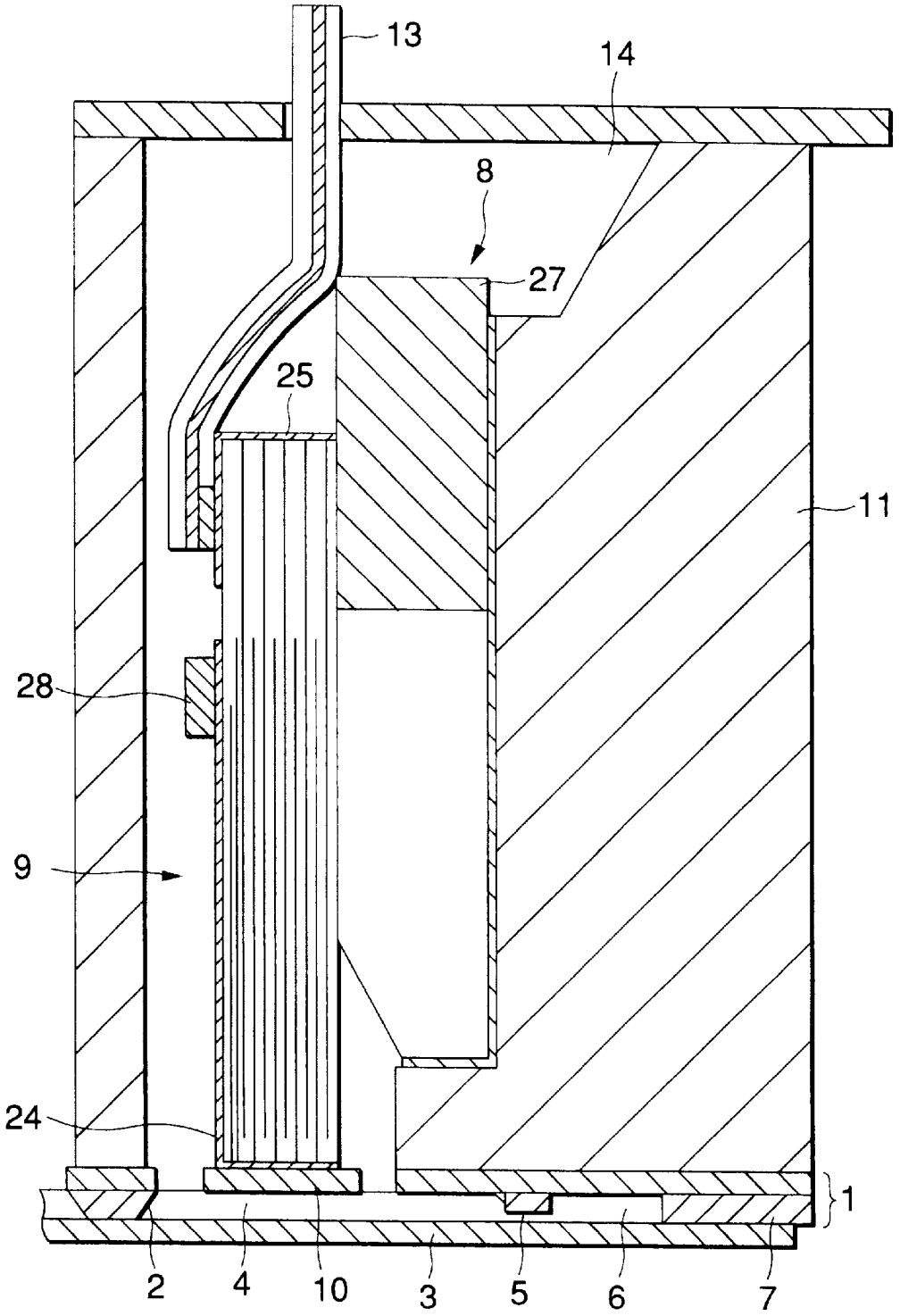
FIG. 2 shows the sectional structure of the above recording head.

FIGS. 1 and 2 show an embodiment of an ink jet recording head according to the present invention. The ink jet recording head includes a passage unit 1 comprising an elastic plate 10, a passage forming board 7 and a nozzle plate 3 which are integrally laminated together as shown in FIG. 1. The nozzle plate 3 has nozzle apertures 2 therein provided at a fixed pitch and the passage forming board 7 includes passages therein for defining a pressure generating chamber 4, an ink supply port 5 and a reservoir 6. Ink is stored in the reservoir 6 and supplied to the pressure generating chamber 4 through the ink supply port 5. As discussed below, ink is ejected through the nozzle apertures 2 upon expansion or contraction of piezoelectric vibrators 9 associated with vibrator unit 8, where the end faces of the piezoelectric vibrators 9 contact the elastic plate 10 adjacent the pressure generating chamber 4. The piezoelectric vibrators 9 are formed with a vibration area and a non-vibration area. The vibration area of the piezoelectric vibrators 9 is provided with an active area which causes the piezoelectric phenomena and an inactive area which creates no piezoelectric phenomena but vibrates together with the active area when the latter vibrates.

The recording head is assembled by securing the passage unit 1 on the opening surface 12 of a holder 11. The holder 11 includes a chamber 14 in which the vibrator unit 8, discussed below, is housed. An elastically deformable ribbon cable 13 is attached to the vibrator unit and includes, for example, a flexible printed circuit (FPC) which transmits a driving signals from an external device. The passage unit 1 is secured to the opening surface 12 of the holder 11 using an adhesive and by attaching a frame 15, which also functions as a shield on the side of the nozzle plate.

Figure 3A:
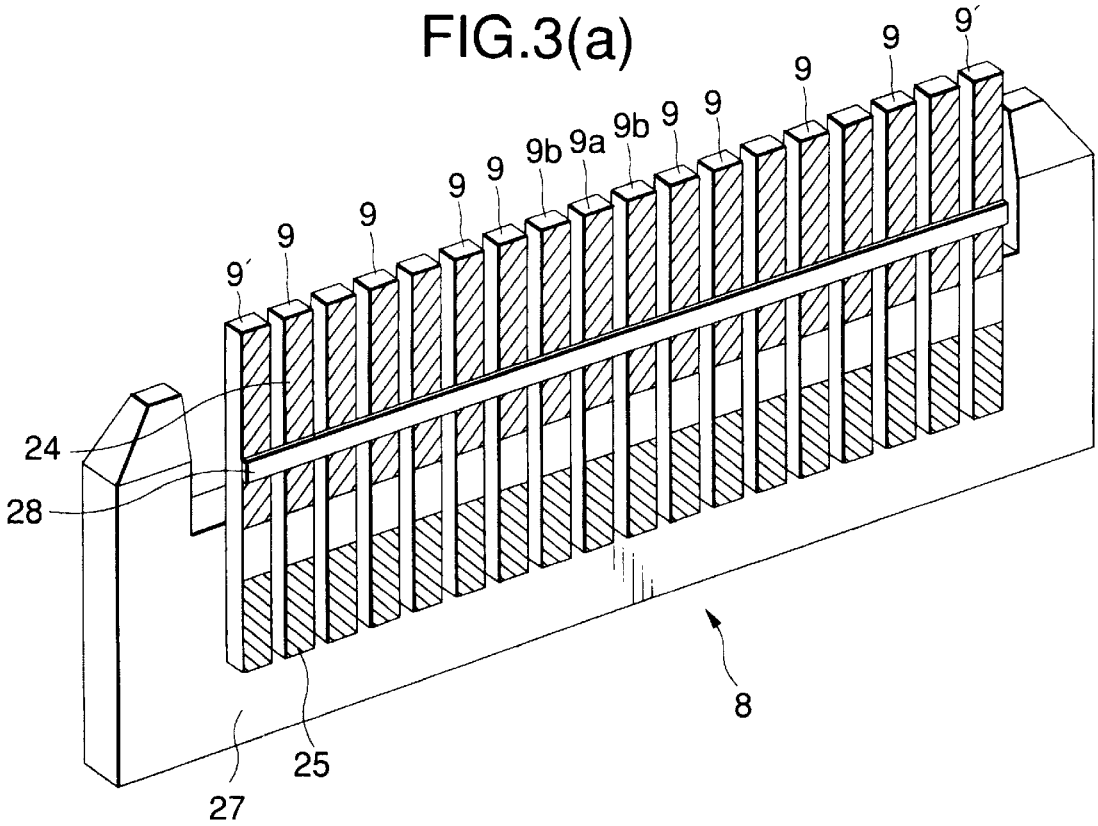
FIGS. 3 (*a*) and 3 (*b*) are respectively a perspective view showing an embodiment of a vibrator unit and the sectional view.
Figure 3B:
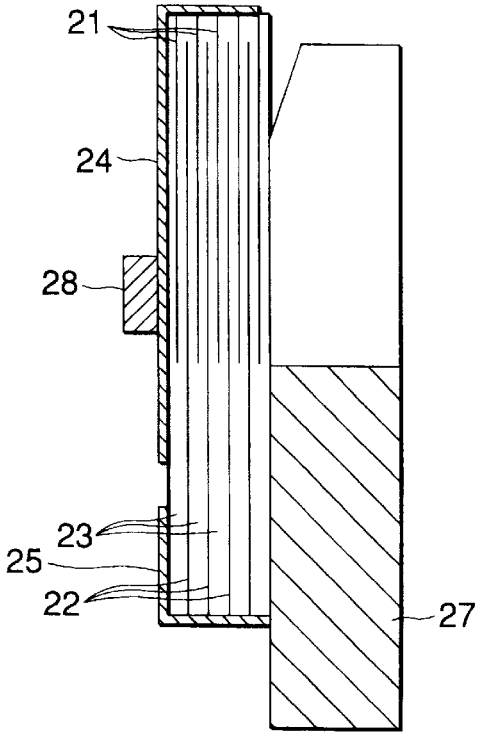

FIGS. 3 (*a*) and (*b*) show an embodiment of the vibrator unit 8. The vibrator unit 8 includes a plurality of piezoelectric vibrators 9 which are fixed to a fixing base 27 at the same pitch as the array pitch of the pressure generating chambers 4. Further, attached to opposite ends of the fixing base are dummy piezoelectric vibrators 9' which are not related to the emission of an ink droplet. For purpose of explanation, the center piezoelectric vibrator is identified by reference characters 9*a* and the immediately adjacent piezoelectric vibrators are identified by 9*b*.

Each piezoelectric vibrator 9, 9', 9*a* or 9*b* is constituted by successively laminating first electrodes 21, which function as one pole, and second electrodes 22, which functions as the other pole between a piezoelectric material 23. The first electrodes 21 are connected to a common electrode 24 and the second electrodes 22 are connected to a segment electrode 25 with the first electrodes 21 being exposed at the end on the free side and the second electrode 22 being exposed at the end on the fixed side.

A connecting member 28, constituted by electrically insulating polymeric elastic material, is fixed to the piezoelectric vibrators in a vibration area so as to extend in a direction in which the piezoelectric vibrators 9, 9*a* and 9*b* are arrayed. The vibration area corresponds to the area which is adjacent to the area of the piezoelectric vibrators which is bonded to the fixing base 27.

The importance of the connecting member is as follows. If a driving signal is applied to only the single piezoelectric vibrator 9*a*, the displacement quantity and speed of the driven piezoelectric vibrator 9*a* are reduced due to the fact that the connecting member 28 is fixed to the driven piezoelectric vibrator 9*a* as well as the adjacent piezoelectric vibrators 9*b*, which are not driven by a driving signal.

If a driving signal is simultaneously applied to a plurality of piezoelectric vibrators, for example all the piezoelectric vibrators 9, 9*a* and 9*b*, the displacement quantity and the displacement speed of the vibrators are equalized because the plural piezoelectric vibrators 9, 9*a* and 9*b* are respectively displaced via the elasticity of the connecting member 28 and only a part of the piezoelectric vibrators 9, 9*a* and 9*b* which receive a driving signal is prevented from being displaced in a special displaced form. That is, according to the result of an experiment using the vibrator unit according to the present invention, if a fixed driving signal of 2.5 V (volts) is applied to the single piezoelectric vibrator 9, the piezoelectric vibrator 9 is displaced by the displacement quantity of 0.057 $\mu$m at the displacement speed of 29 mm/s. If a driving signal is applied to all the piezoelectric vibrators 9, they are displaced by the displacement quantity of 0.058 $\mu$m at the displacement speed of 30 mm/s.

In the meantime, if a conventional type vibrator unit in which the connecting member 28 is not provided and the same driving signal is applied to its single piezoelectric vibrator, the single piezoelectric vibrator is displaced by the displacement quantity of 0.061 $\mu$m at the displacement speed of 36 mm/s. Further, if the same driving signal is applied to all piezoelectric vibrators, the piezoelectric vibrators are displaced by the displacement quantity of 0.058 $\mu$m at the displacement speed of 31 mm/s. Thus, in the conventional type vibrator unit, if all the piezoelectric vibrators are driven, both the displacement quantity and the displacement speed are largely reduced, because the fixing base is bent, compared with a case where only the single piezoelectric vibrator is driven.

That is, in the present invention, the respective coefficients of variation in displacement quantity and displacement speed in a case where only a single piezoelectric vibrator is driven and in a case where all of the piezoelectric vibrators are driven are 2.4% and 2.1%, respectively, because the connecting member 28 constrains the movement of the single piezoelectric vibrator. In contrast, in the conventional type vibrator unit, the respective coefficients of variation in displacement quantity and displacement speed are 5.0% and 14.6%.

Thus, it is evident that the interconnection by the connecting member 28 of plural piezoelectric vibrators 9 constituting the vibrator unit 8 is extremely effective to equalize the displacement quantity and the displacement speed of each piezoelectric vibrator 9.

In the above embodiment, only one side of each piezoelectric vibrator 9 is bonded to the fixing base 27. However, in the embodiment of FIG. 4(*a*), a stepped part 27*a* is formed in the fixing base 27. Each piezoelectric vibrator 9 is positioned within the stepped part 27*a* by abutting the rear end face 91 of the piezoelectric vibrator 9 therein so that two sides of each piezoelectric vibrator is secured to the fixing base. As a result, the regressive quantity of the piezoelectric vibrator 9 caused by the elasticity of an adhesive is reduced so that the pressure generating chamber 4 can be more effectively pressurized, compared with a case in which only one side of the piezoelectric vibrator 9 is bonded to the fixing base 27.

Figure 4A:
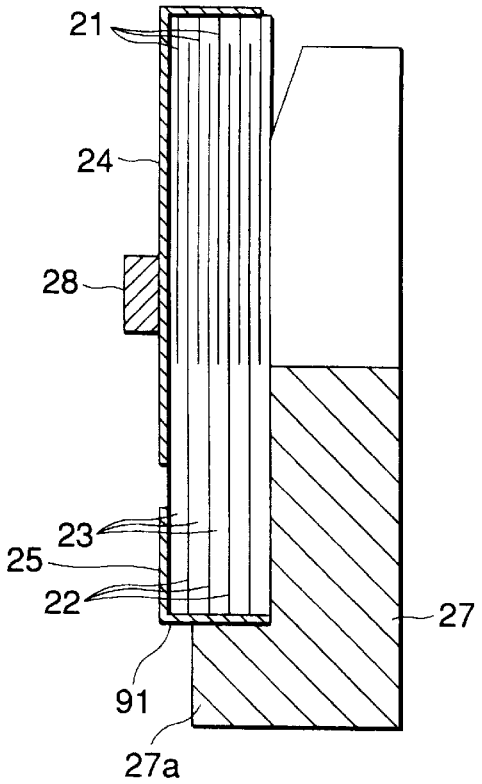
FIGS. 4 (*a*) and 4 (*b*) are sectional views showing different embodiments of the present invention.
Figure 4B:
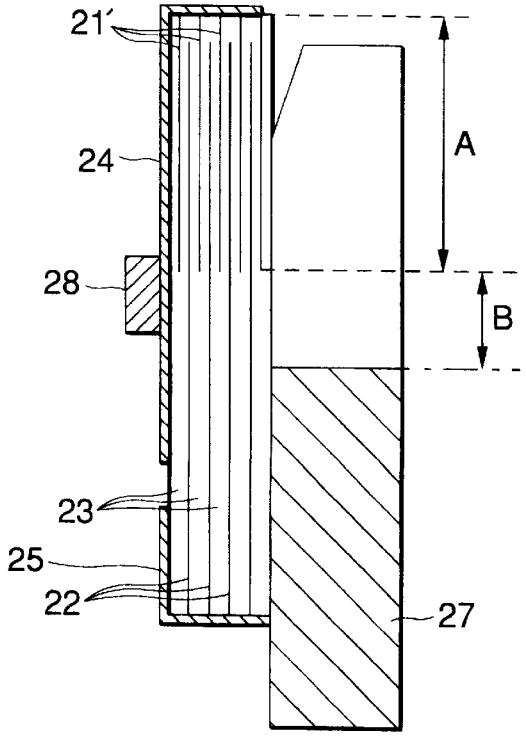

Also, in the above embodiment, the connecting member 28 is fixed to the active area A of each piezoelectric vibrator 9, that is, the area in which the first electrodes 21 and the second electrodes 22 are overlapped. However, if the connecting member 28 is fixed to an inactive area B which is outside the active area A, and protruded from the fixing base 27 as shown in FIG. 4 (*b*), the fluctuation of the displacement characteristic caused at least by the deflection of the fixing base 27 and the elastic deformation of an adhesive layer for fixing each piezoelectric vibrator 9 and the fixing base 27 can be also reduced.

Figure 5A:
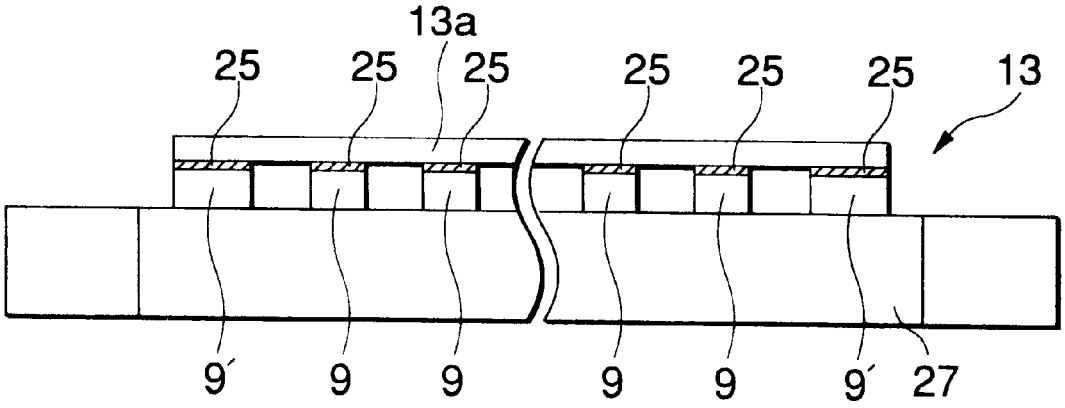
FIGS. 5 (*a*) and 5 (*b*) are respectively the front view and the sectional view of a vibrator unit showing another embodiment of the recording head according to the present invention.
Figure 5B:
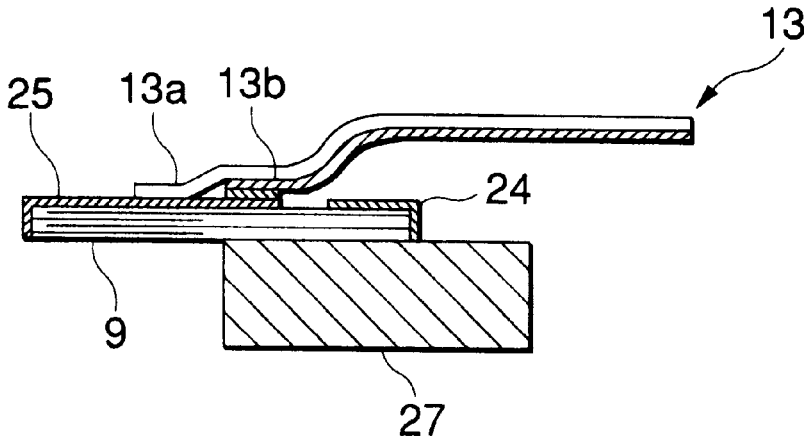

FIGS. 5 (*a*) and 5 (*b*) show another embodiment of the present invention in which the ribbon cable includes a base film 13*a* and a conductive layer 13*b*. In this embodiment, the base film 13*a* extends beyond the end of the conductive layer 13*b* and is secured to the vibrators so that the electric connection of the cable 13 is made in the non-vibration area of the piezoelectric vibrator 9. According to this embodiment, the base film 13*a* is secured to side of the piezoelectric vibrators opposite to the fixing base 27 and at the free end thereof. It is further desirable that the base film 13*a* be fixed to the active area of each piezoelectric vibrator 9 and that both sides of the cable 13 be respectively fixed to dummy piezoelectric vibrators 9'.

According to this embodiment, the displacement characteristic of the piezoelectric vibrator 9 can be equalized by the rigidity of a heat resistant polymeric material, such as polyamide, constituting the base film 13*a*. In other words, the base film 13*a* can function as the above discussed connecting member, thus simplifying the manufacturing process.

Figure 6A:
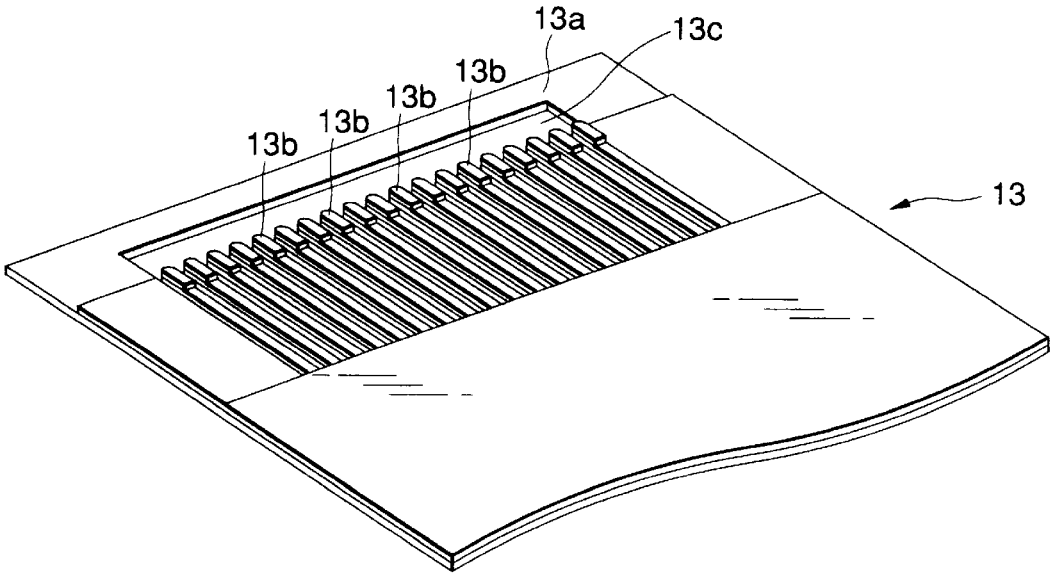
FIGS. 6 (*a*) and 6 (*b*) are respectively a perspective view showing an embodiment of a cable suitable for the above vibrator unit and the front view.
Figure 6B:
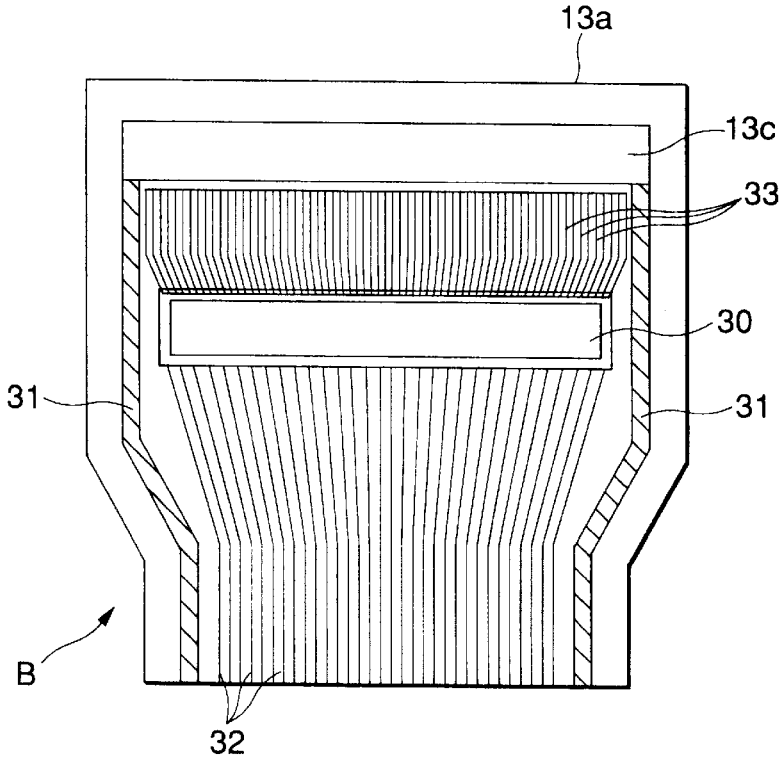

FIG. 6(*a*) shown an alternative arrangement in which a window 13*c* is formed in the ribbon cable between the conductive layer 13*b* and the area in which the base film 13*a* is fixed to the piezoelectric vibrators 9, in the case where the cable 13 is used for the connecting member as described above. With this arrangement, the flexural rigidity between the body of the cable 13 and the end of the cable 13, which functions as the connecting member, can be reduced and the effect of external force (caused by the wiring of the cable 13, etc.) upon the piezoelectric vibrator 9 can be largely reduced.

FIG. 6(*b*) shows details of a cable 13, according to another embodiment of the invention. As shown in FIG. 6(*b*), the cable includes a semiconductor integrated circuit 30 for receiving a signal from a host and generating a signal for driving each piezoelectric vibrator 9, and a conductive pattern 31 formed on both sides of the cable 13*a*. The conductive pattern 31 is connected to a common electrode 25 for each piezoelectric vibrator 9 which is connected to the dummy piezoelectric vibrators 9'.

Specifically, the conductive patterns 31 are connected to the common electrode 25 for each piezoelectric vibrator 9 via an external electrode associated with the dummy piezoelectric vibrators 9'. The cable can be widely formed and the voltage drop can be reduced by adopting such connection structure. A reference number 32 denotes a conductive pattern for transmitting a signal from a host to the semiconductor integrated circuit 30 and a reference number 33 denotes a conductive pattern for transmitting a driving signal generated by the semiconductor integrated circuit 30 to each piezoelectric vibrator 9.

Figure 7A:
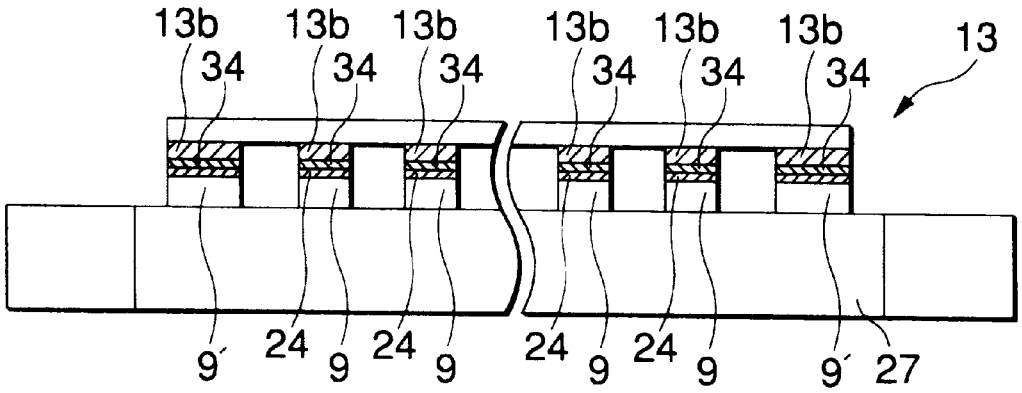
FIGS. 7 (*a*) and 7 (*b*) are respectively the front view and the sectional view of a vibrator unit showing another embodiment of the recording head according to the present invention.
Figure 7B:
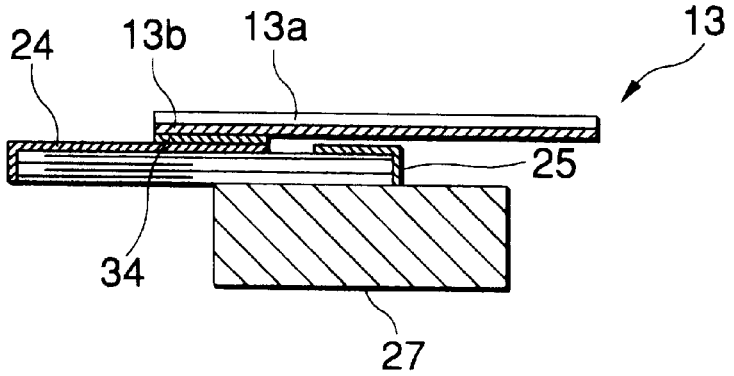

FIGS. 7 (*a*) and 7 (*b*) show another embodiment of the present invention. In this embodiment, both the conductive layer 13*b* and the base material 13*a* of the cable 13 extend to the side of the free end of each piezoelectric vibrator 9, desirably to the active area A. The conductive layer 13*b* is bonded to an electrode 25 in the vibration area of each piezoelectric vibrator 9 by a conductive adhesive layer 34, such as solder or a conductive adhesive. Thus, the strength of the cable 13, acting as a connecting member, is due to the combined rigidity of the base material 13*a* and the conductive layer 13*b*. Thus, the displacement characteristic among piezoelectric vibrators can be effectively equalized.

Figure 8A:
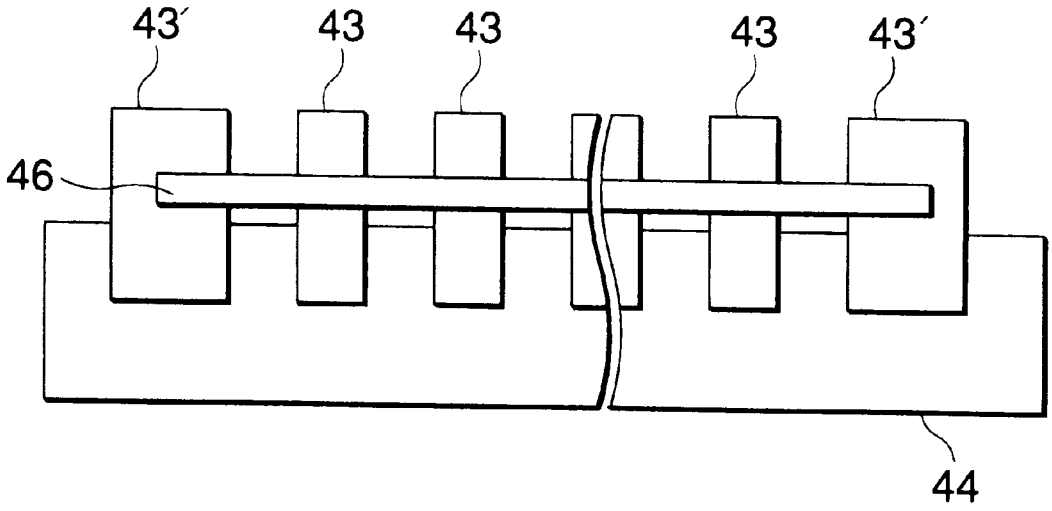
FIGS. 8 (*a*) and 8 (*b*) are respectively the top view and the sectional view of a vibrator unit showing the other embodiment of the present invention.
Figure 8B:
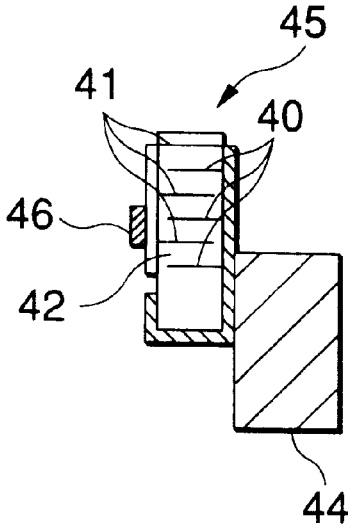

In the above embodiment, the piezoelectric vibrator having a piezoelectric constant of d31 is described as an example. However, as an alternative, a piezoelectric vibrator 43 can be used. Referring to FIGS. 8(*a*) and (*b*), the piezoelectric vibrator 43 is expanded and contracted in an axial direction according to the piezoelectric constant of d31. The piezoelectric vibrator is constituted by vertically laminating internal electrodes 40 and 41, which function as respective poles, between piezoelectric material 42. The plural piezoelectric vibrators are arrayed and fixed to a fixing base 44 and a connecting member 46 is fixed to the side of the free end of each piezoelectric vibrator 43 in a vibrator unit 45. Further, dummy piezoelectric vibrators 43' are provided on both sides in a direction in which the plural piezoelectric vibrators are arrayed as in the above embodiment and both sides of the connecting member 46 are fixed to the dummy piezoelectric vibrators 43' as in the above embodiment.

It is clear that if the connecting member 46 is constituted by a cable for supplying a driving signal to the piezoelectric vibrators 43 as in the above embodiment, the similar action is also produced.

As described above, in the present invention, an elastically deformable connecting member extended in a direction in which piezoelectric vibrators are arrayed is fixed to the side of the free end of each piezoelectric vibrator in an ink jet recording head. As a result, large displacement at the end can be controlled by the elasticity of the connecting member in case a single piezoelectric vibrator is driven, the displacement and the displacement speed of each piezoelectric vibrator can be equalized by the connecting member in case multiple piezoelectric vibrators are simultaneously driven and a displacement characteristic depending upon the number of driven piezoelectric vibrators can be equalized.

What is claimed is:

1. An ink jet recording head, comprising:

a passage unit including at least one nozzle aperture, a chamber associating with said nozzle aperture, and an elastic plate serving as part of a wall of said chamber;

a vibrator unit including a fixing plate, and a plurality of piezoelectric vibrators fixed at one end portion thereof to said fixing plate at a predetermined pitch and contacting said elastic plate at another end portion thereof, said piezoelectric vibrators being actuated in a longitudinal vibration mode for emitting an ink droplet by deflecting said elastic plate to expand or contract said pressure generating chamber; and an elastically deformable connecting member extending across said piezoelectric vibrators in a transverse direction and secured thereto, wherein said connecting member is fixed to a vibration area of said piezoelectric vibrators and controls the displacement of said piezoelectric vibrators.

2. An ink jet recording head according to claim 1, further comprising:

a dummy piezoelectric vibrator disposed adjacent an end one of said piezoelectric vibrators, an end of said connecting member being fixed to said dummy vibrator.

3. An ink jet recording head according to claim 1, wherein said connecting member is fixed to a vibration area of said piezoelectric vibrators, said vibration area corresponding to an area of said piezoelectric vibrators which is separate from an area of said piezoelectric vibrators which is fixed to said fixing plate.

4. An ink jet recording head according to claim 1, wherein said connecting member includes an elastically deformable ribbon cable for supplying a driving signal to said piezoelectric vibrators.

5. An ink jet recording head according to claim 4, wherein said ribbon cable has a window therein so that an area of said ribbon cable corresponds to said connecting member, said area being partitioned from a remainder of said ribbon cable.

6. An ink jet recording head according to claim 4, wherein said ribbon cable includes a base film and a conductive layer, said base film extending beyond said conductive layer and being bonded to said piezoelectric vibrators.

7. An ink jet recording head according to claim 6, wherein the electrical connection of the base film of the ribbon cable is in a non-vibration area of the piezoelectric vibrators.

8. An ink jet recording head according to claim 6, wherein said base film is secured to an active area of the piezoelectric vibrators.

9. An ink jet recording head according to claim 4, further comprising a plurality of electrodes respectively provided on said piezoelectric vibrators, wherein conductors of a conductive layer of said cable are bonded to said electrodes, respectively.

10. An ink jet recording head according to claim 4, further comprising a semiconductor integrated circuit for driving said piezoelectric vibrators, said semiconductor integrated circuit being mounted on said ribbon cable.

11. An ink jet recording head according to claim 4, wherein a conductive pattern for connecting to said dummy piezoelectric vibrator is formed on said cable.

12. An ink jet recording head according to claim 1, wherein each of said piezoelectric vibrators is positioned within a stepped part of said fixing base so that two sides of said piezoelectric vibrators are adhered to said fixing base.

13. An ink jet recording head according to claim 1, wherein said piezoelectric vibrators each includes piezoelectric material and a plurality of internal electrodes alternately laminated.

14. An ink jet recording head according to claim 13, wherein said internal electrodes are arranged in parallel with a direction in which said piezoelectric vibrators are expanded and contracted.

15. An ink jet recording head according to claim 13, wherein said internal electrodes are arranged perpendicular to a direction in which said piezoelectric vibrators are expanded and contracted.

16. An ink jet recording head according to claim 1, wherein said connecting member is disposed on an active area of said vibration area of said piezoelectric vibrators.

17. An ink jet recording head according to claim 1, wherein said connecting member is disposed on an inactive area of said vibration area of said piezoelectric vibrators.

* * * * *